US011305926B2

(12) United States Patent
Larsson et al.

(10) Patent No.: US 11,305,926 B2
(45) Date of Patent: Apr. 19, 2022

(54) ONE-WAY VALVE FOR FOOD PACKAGES

(71) Applicant: MICVAC AB, Mölndal (SE)

(72) Inventors: Fredrik Larsson, Mölndal (SE); Johan Zetterberg, Båstad (SE)

(73) Assignee: MICVAC AB, Mölndal (SE)

( * ) Notice: Subject to any disclaimer, the term of this patent is extended or adjusted under 35 U.S.C. 154(b) by 35 days.

(21) Appl. No.: 16/494,867

(22) PCT Filed: Mar. 15, 2018

(86) PCT No.: PCT/EP2018/056538
§ 371 (c)(1),
(2) Date: Sep. 17, 2019

(87) PCT Pub. No.: WO2018/167211
PCT Pub. Date: Sep. 20, 2018

(65) Prior Publication Data

US 2020/0010256 A1 Jan. 9, 2020

(30) Foreign Application Priority Data

Mar. 17, 2017 (EP) ..... 17161606

(51) Int. Cl.
*B65D 77/22* (2006.01)
*B65D 51/16* (2006.01)
*B65D 81/34* (2006.01)

(52) U.S. Cl.
CPC ..... *B65D 77/225* (2013.01); *B65D 51/1644* (2013.01); *B65D 81/34* (2013.01); *B65D 2205/025* (2013.01); *B65D 2581/34* (2013.01)

(58) Field of Classification Search
CPC ..... H05B 6/80; B65D 33/16; B65D 31/147; B65D 31/142; B65D 31/14; B65D 77/225;
(Continued)

(56) References Cited

U.S. PATENT DOCUMENTS 5,587,192 A * 12/1996 Beizermann ..... B65D 77/225 220/360
5,833,090 A * 11/1998 Rojek ..... B65D 51/1683 215/262
(Continued)

FOREIGN PATENT DOCUMENTS

EP 1383693 A1 1/2004
JP S63156978 U * 10/1988 ..... B65D 51/16
(Continued)

OTHER PUBLICATIONS

PCT Application No. PCT/EP2018/056538, International Search Report, dated Jun. 6, 2018, 2 pages.
(Continued)

*Primary Examiner* — Kareen K Thomas
(74) *Attorney, Agent, or Firm* — Buchanan Ingersoll & Rooney P.C.

(57) ABSTRACT

A one-way valve, a food package comprising such a one-way valve and a method for manufacturing such a one-way valve is disclosed. The valve comprises a first membrane and a second membrane having a smaller surface area than the first membrane and furthermore being fixed to a bottom surface of the second membrane. The valve is furthermore adapted to be fixed to the food package and cover the aperture such that a canal is formed between the food package and the second membrane when a gas pressure inside the food package exceeds a threshold value, the canal extending from the aperture to the peripheral edge of the first membrane along the second membrane.

20 Claims, 4 Drawing Sheets

(58) Field of Classification Search
CPC ..... B65D 51/1644; B65D 81/34; B65D 2205/025; B65D 2581/34
See application file for complete search history.

(56) References Cited

U.S. PATENT DOCUMENTS 5,989,608 A 11/1999 Mizuno
6,023,915 A * 2/2000 Colombo ..... B65D 77/225 206/204
6,513,659 B1 * 2/2003 Ogura ..... B65D 51/1633 206/524.8
6,660,983 B2 * 12/2003 Monforton ..... B65D 75/5855 219/727
6,663,284 B2 * 12/2003 Buckingham ..... B65D 77/225 220/203.15
6,733,807 B2 * 5/2004 Martuch ..... B65D 75/5855 219/727
6,814,991 B2 * 11/2004 Hiyoshi ..... B65D 77/225 426/113
7,051,762 B2 * 5/2006 Haamer ..... B65D 77/225 137/855
7,178,555 B2 * 2/2007 Engel ..... B65D 77/225 137/843
7,685,793 B2 * 3/2010 Newrones ..... F16K 15/144 53/405
7,798,713 B2 * 9/2010 Blythe ..... B65D 33/2591 383/63
2016/0176613 A1 6/2016 Tzu

FOREIGN PATENT DOCUMENTS

JP H0615880 A 1/1994
JP 3061234 U 9/1999
JP 2007534561 A 11/2007
JP 2013144574 A 7/2013
JP 2014526337 A 9/2014
JP 2015131649 A 7/2015

OTHER PUBLICATIONS

Official Action in corresponding Japanese Application No. 2019-550243, dated Jan. 18, 2022 (with machine translation), 11 pages.

* cited by examiner

ONE-WAY VALVE FOR FOOD PACKAGES

CROSS-REFERENCE TO RELATED APPLICATIONS

This application is the U.S. National phase of, and claims priority to, International Application No. PCT/EP2018/056538, filed Mar. 15, 2018, which designated the U.S. and which claims priority to EP Application No. 17161606.3, filed Mar. 17, 2017. These applications are each incorporated herein by reference in their entireties.

TECHNICAL FIELD OF THE INVENTION

The invention relates to a one-way valve. In particular the invention relates to a one-way valve designed to be mounted on a food package and arranged to open in response to a pressure inside the package exceeding a threshold pressure. The invention also relates to a food package comprising such a one-way valve and a method for manufacturing such a one-way valve.

BACKGROUND

A growing trend in the world is the consumption of so called ready-to-eat food, i.e., food which does not need cooking or has already been cooked. Such meals are either frozen or refrigerated in order to have a reasonable long shelf life. Frozen food may be regarded as less tasty and looking less appetizing. While refrigerated food generally appears more appetizing, it has considerably shorter shelf life. In order to prolong the shelf life for such refrigerated ready-to-eat food, pasteurisation is used. Often, the process of pasteurisation is combined with a removal of oxygen from the interior of the package in order to minimise bacterial growth. Such removal of oxygen may be accomplished by either creating a slight vacuum in the food package or replacing the oxygen by injection of some other suitable gas into the food package.

In one cooking and pasteurisation method used by the applicant the food is placed in a food package comprising a plastic tray having a plastic cover in the form of a see-through thin film which is sealed along the tray edges to create an interior which is completely sealed off from the surroundings. Further, a valve may be provided in this plastic film which may be automatically opened when an overpressure occurs within the package. Such overpressures are for example, created when the package is positioned in a microwave oven and the food is cooked by exposing it to electromagnetic radiation. It may also be created through convection for example, in furnaces with air heating and steam, or by exposing the package to thermal radiation, e.g., through infra-red radiation. When the food is cooked, a large amount of steam is created. The steam builds up an overpressure such that the valve is opened, letting both oxygen and steam out. When the food has been cooked the microwave oven is shut off, whereby the steam production instantaneously stops. The valve is then designed to close immediately due to the reduction of internal overpressure and the lowering of the ambient temperatures. The food packages are cooled to a suitable storing temperature and may be delivered to retailers for later use. An important aspect is that these types of valves differ from other valves used in the food industry, such as, for example, those used in connection with packages for coffee or the like. In more detail, these valves open at much higher relative overpressures, in the range of 100 hPa, as compared to those used in connection with packages for coffee which open at relative overpressures in the range of 10 hPa. The term relative overpressure refers to how much the pressure inside the package exceeds the pressure outside of the food package, i.e. the difference between the internal and the external pressure. This consequently results in different requirements for the different types of valves.

The closure of the valve after cooking is important in order to seal the interior of the package and food from ambient air and contaminating substances. The valve must hence be designed such that it is certain that it is not affected by for example, food residuals or moisture that may be blown into the valve during cooking.

Such valves are per se known, and commercially available from the applicant, Micvac AB, of Mölndal, Sweden, and are also disclosed in EP 1 383 693 by the same applicant. However, it is known that single layer one-way valves are prone to some general drawbacks, mainly in terms of assembly due to the fact that they have to be assembled during production of the food package.

As a remedy to this, EP 1 633 655, also by the applicant, Micvac AB, of Mölndal, Sweden, the disclosure of which is incorporated herein by reference, proposes a two-layer solution where one of the two layers is provided with an opening such that air is allowed to escape between the two layers by suitably applying different adhesives or ultrasonically welding certain parts of the two layers to each other. This allows for the valve to be assembled elsewhere under more appropriate conditions. Also, the channel between the layers, through which air from inside the package may pass, can be well defined in order to reduce the formation of bubbles or wrinkles during opening and closing of the valve.

Moreover, many of the commercially available one-way valves for food packages include thermoelastic poly(vinyl chloride), i.e. PVC treated with plasticisers. Thermoelastic PVC has generally been utilized because of low cost and advantageous material properties. However, due to increasing governmental restrictions, which regulate the use of thermoelastic PVC in food applications, it would be desirable to have a one-way valve which is still reliable and cost effective and simultaneously alleviates the food safety issues associated with thermoelastic PVC.

Accordingly, there is always a need for improvements in the art, and particularly there is always a need for one-way valves that are more cost effective, easier to manufacture and is more in compliance with coming governmental health regulations. Stated differently, there is still a need for a one-way valve that may be easily and reliably fastened to a plastic film of a food package in a manner that is less complicated as compared to previously known valves.

SUMMARY OF THE INVENTION

It is therefore one object of the invention to provide a one-way valve, a food package comprising such a one-way valve, and a method for manufacturing a one-way valve which alleviate all or at least some of the above-discussed drawbacks of the presently known solutions.

According to an aspect of the invention, there is provided a one-way valve for mounting over an aperture formed on a food package for cooking, storing and/or heating ready-to-eat food. The one-way valve comprises a first membrane having a top surface and a bottom surface. The first membrane also has a first surface area. The one-way valve further comprises a second membrane with a proximal surface, a distal surface and a second surface area, which is smaller than the first surface area. The distal surface of the second membrane is coated with an adhesive and the proximal surface of the second membrane is fixed to the bottom surface of the first membrane such that a peripheral edge of the second membrane aligns with or extends past a peripheral edge of the first membrane. Furthermore, the one-way valve is adapted to be fixed to the food package in order to cover the aperture with the second membrane such that a canal is formed between the food package and the second membrane when a gas pressure inside the food package exceeds a threshold value. The canal extends from the aperture to the peripheral edge of the first membrane along the second membrane.

Hereby, a simple and cost effective one-way valve particularly suitable for food packages containing food stuffs is presented. The inventive one-way valve requires less material and is easier to manufacture as compared to equivalent conventional valves in terms of performance and function. This is at least partly because some work intensive and/or time-consuming manufacturing steps can be completely or at least partly omitted, such as, e.g., ultrasonic welding, applying adhesive in predefined patterns, punching holes in the second membrane, et cetera). Additionally, since there is no hole in the bottom membrane, the delicate production step of aligning the hole in the bottom membrane with an aperture in the food package is alleviated which saves time during assembly. Moreover, the second membrane (may also be referred to as bottom membrane) does not have to be made from thermoelastic PVC, i.e. PVC treated with plasticisers/plasticizers, as in conventional solutions. Consequently, any contact between the food content and thermoelastic PVC can be avoided.

When the food in the food package is heated, either during cooking of the food or when it is re-heated in preparation for consumption, steam is created. When steam is created, the purpose of the one-way valve is that it should open and release the steam from the package, and when the heating process is stopped, the valve should close in order to assist in preventing the food from being contaminated.

The second membrane may be fixed to the bottom surface of the first membrane by, for example, coating at least a section or portion of the bottom surface of the first membrane with an adhesive, and attaching the proximal surface of the second membrane thereto. Advantageously the whole bottom surface of the first membrane is coated with the same adhesive, whereby the overlapping portions of the first membrane can be adhered to the food package in order to mount the one-way valve to the food package. However, in alternative embodiments, the second membrane can be ultrasonically welded or otherwise bonded to the first membrane. Similarly, the overlapping portions of the first membrane can be ultrasonically welded or otherwise bonded to the food package in order to sandwich the first membrane between the two. For example, the food package may include a plastic film (with an aperture) fixed to a rigid container. Accordingly, the one-way valve and the plastic film may be manufactured in the same process.

The invention is based on the realization that by providing a one-way valve for food packages with two membranes, where the bottom membrane has a smaller surface area than the top membrane, and then utilizing the smaller membrane to define the airway passage or canal which forms during an overpressure within the food package, several advantages in terms of manufacturability and cost effectiveness are achieved. For example, the need for providing a cut or opening on one of the membranes, as known in prior art systems, is diminished, thus at least one process step can be completely omitted for the present invention as compared to prior known solutions. Moreover, the inventive one-way valve is suitable for a wider range of applications due to its ability to "open" even during relatively low overpressures in contrast to conventional "two-layer" solutions by having an adhesive with low adhesion or having less adhesive or even having no adhesive at all on the bottom surface of the second membrane.

Further, the inventors realized that the smaller second membrane can be utilized as a passive component during the expansion of the one-way valve (when the food package is heated and the gas pressure inside the food package exceeds a threshold and the canal is formed), whereby the degree of freedom in reference to the material choice for the second membrane is increased as compared to prior known solutions. Thus, the inventive one-way valve is more in-line with coming health regulations which restrict the use of PVC in the food industry. In fact, an increasing number of health organizations do not allow any contact between thermoelastic PVC and foodstuffs. To some extent, the second membrane can be said to form a carrier membrane, i.e. to provide a carrying surface for a weaker adhesive as compared to a stronger adhesive generally applied on the bottom surface of the first membrane in order to fix the two membranes to each other and subsequently to mount the valve to the food package.

Moreover, the need for either welding the two membranes or applying different adhesives on specific portions or sections of a single surface is reduced, whereby manufacturing complexity and therefore costs can be reduced. In short it may be said that the inventive valve combines the manufacturing simplicity and cost effectiveness of single membrane valves together with the reliability and preciseness of two-layer valves, while at the same time being compliant with regulations related to PVC in contact with foodstuffs. It should be noted that, even if, the two membranes may in some embodiments be welded to each other, it is not essential.

In accordance with an embodiment of the invention, the second membrane defines the canal through which gas inside the food package can exit when the gas pressure inside the food package exceeds the threshold value. Hereby, the gas inside the food package can only exit along one or more predefined paths, whereby bubbles and wrinkles which are known to form, when the canal closes, are avoided. It has been realized by the inventors that if the gas is allowed to exit in a random manner via the one-way valve, the risk of bubble or wrinkle formation is increased since it is difficult to predict in which portion of the one-way valve the canal will form and accordingly it is difficult to properly arrange the one-way valve (e.g. by considering machining directions) in order to avoid bubble/wrinkle formation. Moreover, by utilizing the entire distal surface of the second membrane to define the canal (instead of for example applying different types of adhesives on different sections of a surface) the canal will be well defined and manufacturing complexity and costs are reduced.

Naturally, it may to some extent be understood that the airway canal is defined by both the first membrane and the second membrane, since the first membrane almost entirely encloses the second membrane and fixes the same to the food package. More specifically, the airway canal can be understood as being defined in a substantially horizontal direction (i.e. along an outer surface of the food package) by the first membrane, and in a substantially vertical direction (i.e. perpendicular to the outer surface of the food package) by the smaller second membrane.

Further, the terminology defining that a peripheral edge of the second membrane is aligning with or extending past a corresponding peripheral edge of the first membrane means that the first membrane extends past all but one edge or side of the second membrane. In another embodiment of the invention, the first membrane extends past two opposite edges of the second membrane. In other words, two oppositely positioned peripheral edges of the second membrane align with or extend past two oppositely positioned peripheral edges of the first membrane.

For example, if the second membrane is a rectangular membrane which includes four sides, i.e. two short sides and two long sides. Then the first membrane preferably extends past at least the two long sides of the second membrane, and optionally one of the short sides as well. It goes without saying that other shapes of each of the membranes are also feasible, for example the second membrane may have a polygonal shape, in which case, the first membrane can still be arranged such that it extends past all except one or two peripheral edge sections. Similarly, if the second membrane would be of a circular, elliptic or otherwise curved shape, the first membrane is preferably arranged to extend past the whole circumferential edge of the first membrane except for past one or two arcs of the circumferential edge. An arc is to be understood as a sub-portion of an elliptic circumferential edge.

In accordance with another embodiment of the present invention, the distal surface of the second membrane is coated with a first adhesive, and the bottom surface of the first membrane is coated with a second adhesive, the first adhesive having a lower adhesion than the second adhesive. The bottom surface of the first membrane preferably, but not necessarily, has a uniform coating of the second (stronger) adhesive. Thereby the same adhesive is used to fix the first membrane and second membrane to each other, and also to fix the whole one-way valve to the food package. By coating the bottom surface of the first membrane with only one adhesive the manufacturing process is simplified since there is no need for applying different types of adhesives on different areas of the membranes. Moreover, the lower adhesion of adhesive applied to the distal surface of the second membrane may be provided by a release coating. In other words, the two bottom surfaces of the two separate membranes may be arranged with the same adhesive, and where the bottom surface of the second membrane can subsequently be sprayed, printed or coated with a release coating in order to lower the adhesion. The release coating may for example be a silicone based substance, such as, for example, silicone oil. However, other alternatives are also feasible. The purpose of the release coating is to reduce the adhesion (or adhesive properties) of the adhesive, and any substance or material fulfilling that purpose and that is able to be applied on an adhesive in a controlled manner (e.g. printing or spraying) may suitably be used.

The terms "lower" and "higher" adhesion should be understood as that two substrates being fixed together by means of an adhesive are easier to separate if the adhesive has a lower adhesion as compared to if the adhesive would have had a higher adhesion.

Further, in accordance with yet another embodiment of the invention, the first membrane is made of a thermoelastic material which has a production machine direction, and the second membrane is arranged such that the canal extends in a direction that has a relationship to the production machine direction such that an angle therebetween is within a range of 60°-90°. Hereby, the risk of wrinkle formation is further reduced since the relaxation of the polymers will actually tighten the canal during steam/gas release. Moreover, the canal can be made shorter whereby the complete one-way valve can be made smaller.

Even further, in accordance with yet another embodiment of the invention, the thermoelastic material is in an elastic state at temperatures exceeding 50° C. As mentioned, one intended purpose of the valve is that it should open when the food package is subjected to heating, and steam thereby is created, and close when there is no more steam being generated within the food package. It may therefore be advantageous to use thermoelastic (thermoplastic) materials being in its elastic state at temperatures exceeding 50° C. Hence, when the food package is being stored, e.g. in a refrigerated space, the valve membranes are not in their elastic state which provides for reliable closing of the valve.

Yet further, in accordance with yet another embodiment of the invention, the first membrane is made of thermoelastic PVC, poly(vinyl chloride), and the second membrane is made of a different polymer. The different polymer may for example be PP (polypropylene) or other suitable synthetic polymers such as, polyethylene, polystyrene, polyurethane, et cetera. Stated differently the second membrane is made of a non-PVC polymer.

In accordance with another aspect of the invention, there is provided a food package for cooking, storing and/or heating of ready-to-eat food, the food package comprising a food container and a plastic film for sealing the food package from ambient air, the plastic film including an aperture. The food package further comprises a one-way valve covering the aperture. The one-way valve has a first membrane having a top surface and a bottom surface, the first membrane having a first surface area. The one-way valve further includes a second membrane having a proximal surface and a distal surface, and a second surface area that is smaller than the first surface area. The distal surface is coated with an adhesive and the proximal surface is fixed to the bottom surface of the first membrane such that a peripheral edge of the second membrane aligns with or extends past a peripheral edge of the first membrane. The one-way valve is arranged on the plastic film so that the second membrane covers the aperture whereby a canal is formed between the food package and the second membrane when a gas pressure inside the food package exceeds a threshold value. The canal extends from the aperture to the peripheral edge of the first membrane along the second membrane.

Hereby a cost effective and reliable food package for cooking, storing and/or heating ready-to-eat food is presented.

In this aspect of the invention, similar advantages and preferred features may be present as described in other aspects of the invention, and vice versa. Thus, the food package of the second aspect may comprise any one of the embodiments of the one-way valve discussed in reference to the previous aspect of the invention. For example, the one-way valve could be ultrasonically welded to the plastic film by welding the portions of the first membrane surrounding the second membrane to the plastic film (e.g. before the plastic film is fixed to the food package). However, as mentioned, in other embodiments of the invention the valve can be adhered or otherwise bonded to the plastic film.

Further, in accordance with yet another aspect of the invention, a method for manufacturing a one-way valve for mounting over an aperture formed on a food package for cooking, storing and/or heating of ready-to-eat food, includes providing a first membrane having a top surface and a bottom surface, the first membrane having a first surface area; providing a second membrane having a proximal surface and a distal surface, the second membrane having a second surface area smaller than the first surface area; coating the distal surface of the second membrane with a first adhesive; coating the bottom surface of the first membrane with a second adhesive, the first adhesive having lower adhesion than the second adhesive; and fixing the proximal surface second membrane to the bottom surface of the first membrane, such that a peripheral edge of the second membrane aligns with or extends past a peripheral edge of the first membrane.

In this aspect of the invention, similar advantages and preferred features may be present as described in other aspects of the invention, and vice versa.

These and other features and advantages of the invention will be further clarified with reference to the embodiments described hereinafter.

BRIEF DESCRIPTION OF THE DRAWINGS

For exemplifying purposes, the invention will be described in closer detail in the following with reference to embodiments thereof illustrated in the attached drawings, wherein.

DETAILED DESCRIPTION

In the following detailed description, embodiments of the invention are described. However, it is to be understood that features of the different embodiments are exchangeable between the embodiments and may be combined in different ways, unless anything else is specifically indicated. Even though in the following description numerous specific details are set forth to provide a more thorough understanding of the invention, it will be apparent to one skilled in the art that the invention may be practiced without these specific details. In other instances, well known constructions or functions are not described in detail, so as not to obscure the invention.

Figure 1A:
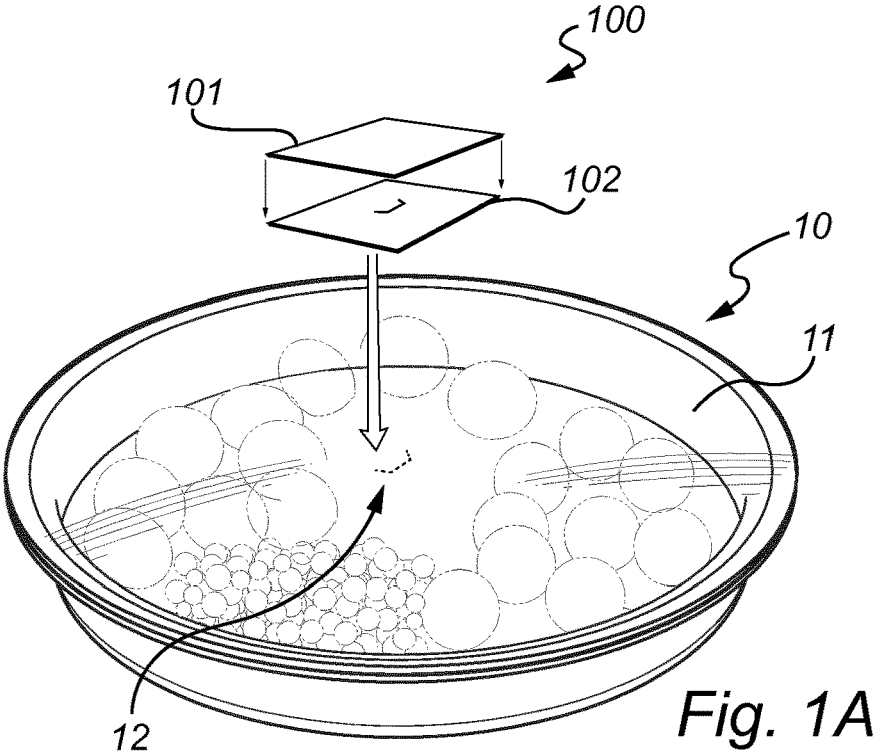
Fig. 1A Prior Art
FIG. 1A illustrates a perspective view of a valve in accordance with the prior art as applied on a food package.

FIG. 1A shows a one-way valve 100 intended for application on a food package 10, in accordance with the prior art. More particularly, the one-way valve 100 is intended to be arranged to cover an aperture or opening 12 formed in the food package 10. The conventional one-way valve 100 includes a two-layer structure, where the bottom layer 102 is provided with an aperture 103 which should be aligned with the aperture 12 formed in the food package 10 when the valve 12 is mounted onto the food package 10. Once the gas pressure inside the food package 10 exceeds some threshold value (e.g. during heating of the food package 10) a canal is formed between the two layers 101, 102. In order to provide the gas releasing function, the intermediate surfaces of the two layers 101, 102 (i.e. the surface of each layer 101, 102 facing the other layer 101, 102) are generally fixed together by means of two different adhesives. In more detail, a stronger adhesive is applied to a first surface portion surrounding the intended canal, and a weaker adhesive is applied only to a second surface portion which is intended to define the canal. However, instead of using different adhesives, one can coat the entire intermediate surfaces with a weaker adhesive and ultrasonically weld the surface portion surrounding the intended canal (i.e. the surrounding edge surfaces) during a subsequent process step. In order to alleviate problems associated with bubble and wrinkle formation, both of the layers 101, 102 are made from thermoelastic PVC, which results in an increased risk of the food content of the food package 10 coming in contact with the contaminants associated with the thermoelastic PVC.

Figure 1B:
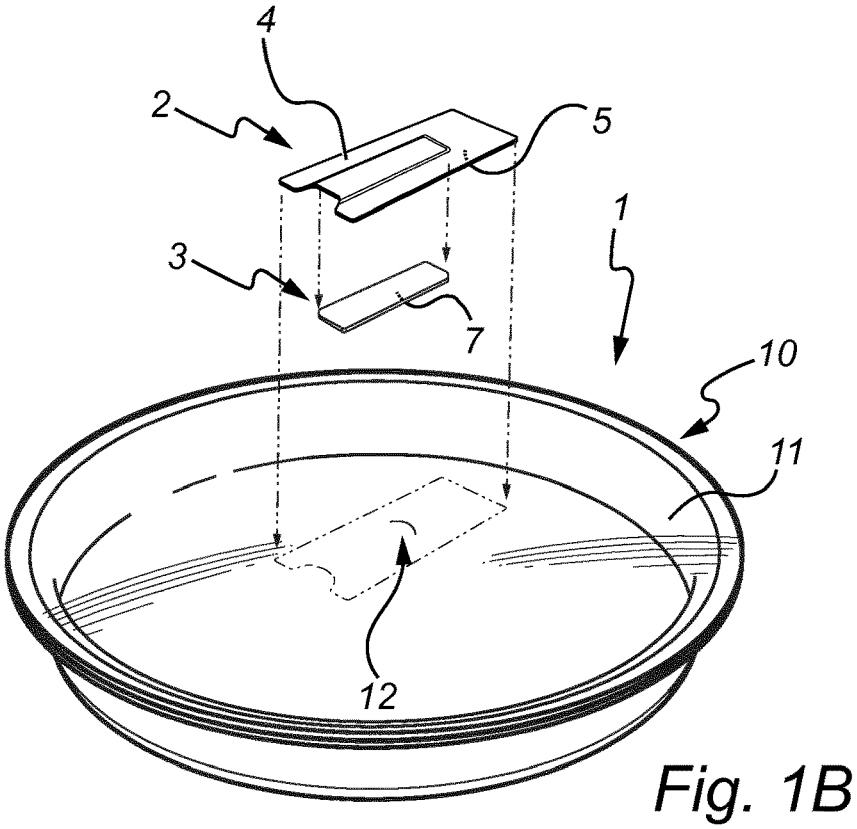
FIG. 1B illustrates a perspective and partially exploded view of a one-way valve applied on a food package, in accordance with an embodiment of the invention.

FIG. 1B shows a perspective and partially exploded view of a one-way valve 1 mounted over an aperture 12 formed in a food package 10 for cooking, storing and/or heating ready-to-eat food, in accordance with an embodiment of the invention. The food package here is in the form of a rigid container, preferably made of a suitable plastic material, covered with a plastic film 11 for sealing the inside of the food package from the ambient atmosphere. The plastic film 11 is fixed along the outer circumference of the rigid container of the food package 10.

The one-way valve 1 comprises a first membrane 2 (which may also be referred to as a top layer or a top membrane) with a first surface area and a second membrane 3 (which may also be referred to as a bottom layer or a bottom membrane) with a second surface area which is smaller than that of the first membrane 2. The first membrane 2 has a bottom surface 5, which is preferably coated with an adhesive in order to stick to the proximal (i.e. the top surface) of the second membrane 3 and also to the plastic film 11 of the food package 10. The first membrane 2 can, for example, be made from thermoelastic PVC. The term distal in reference to the surfaces of the second membrane 3 is to be understood as the surface situated away from the point of attachment to the first membrane 2, i.e. the surface facing away from the first membrane 2. Analogously, the term proximal in reference to the surfaces of the second membrane 3 is to be understood as the surface situated nearer to the point of attachment to the first membrane 2, i.e. the surface facing towards the first membrane 2.

The second membrane 3 is as mentioned fixed to the bottom surface 5 of the first membrane 2 and adapted to be sandwiched between the food package 10, and the first membrane 2, when the one-way valve is mounted onto the food package 10. The second membrane 3 has a rectangular shape and the first membrane 2 extends past three sides or edge of the second membrane 3 in order to fix the second membrane 3 to the food package 10. The second membrane 3 can be made from PP (polypropylene) or from other suitable synthetic polymers such as, polyethylene, polystyrene, polyurethane, etc.

The one-way valve 1 is to be mounted to the food package 10, as indicated by the downwardly directed arrows in FIG. 1B, such that the second membrane 3 covers the aperture 12, here in the form of a cut, formed in the plastic film 11 of the food package 10. In use, for example when the food package 10 is heated, a canal is formed between the plastic film 11 and the second membrane 3 when a gas pressure inside the food package exceeds a (predefined) threshold value. The canal will accordingly extend from the aperture 12 towards a peripheral edge 21 (see FIGS. 2A, 2B, 4A, 4B) of the first membrane 2, along the second membrane 3. The canal forms because the second membrane 3 separates from the plastic film 11 of the food package 11 as a result of the force exerted on the bottom surface 7 of the second membrane 3 by the expanding gas.

The aforementioned peripheral edge of the first membrane 2 is aligned with a peripheral edge of the second membrane 3. Also, the second membrane 3 defines or delineates the canal through which gas inside the food package 10 can exit when the gas pressure inside the food package 10 exceeds the threshold value.

The distal surface 7 of the second membrane 3 is coated with an adhesive. However, the adhesive coated on the distal surface 7 of the second membrane 3 has a lower adhesion than the adhesive provided on the bottom surface 5 of the first membrane 2. By providing a relatively weak adhesive on the distal surface 7 of the second membrane 3 it is possible to control the threshold value for the gas pressure inside the food package. In other words, by using a weaker adhesive the threshold value can be lowered, and by using a stronger adhesive the threshold value can be increased. Stated differently, the threshold gas pressure is preferably controlled by controlling the adhesion of the adhesive applied on the distal surface 7 of the second membrane 3, i.e. by increasing or decreasing the adhesive strength of the adhesive applied on the distal surface 7. This can be tested in a peel test, for example.

The gas pressure threshold value (or also known as opening pressure) can, for example, be in the range of 10-200 mbar at 70-100° C. Preferably the opening pressure is in the range of 20-130 mbar, 40-160 mbar, or even 60-100 mbar, at 70-100° C. The gas pressure threshold value is in the present context to be understood as an "internal overpressure", i.e. a relative gas pressure difference between the inside of the food package 10 and the outside of the food package.

Figure 2A:
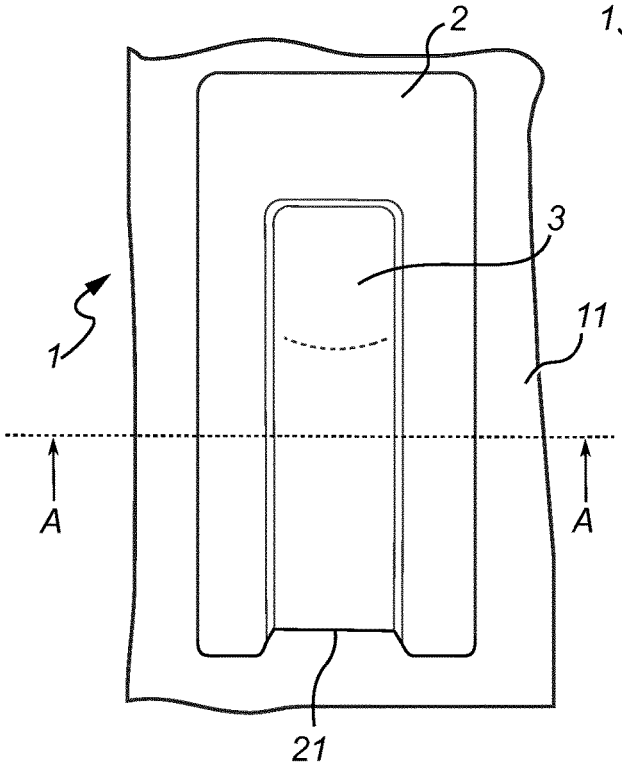
FIG. 2A illustrates a top view perspective of the one-way valve arranged on a food package in FIG. 1B.
Figure 2B:
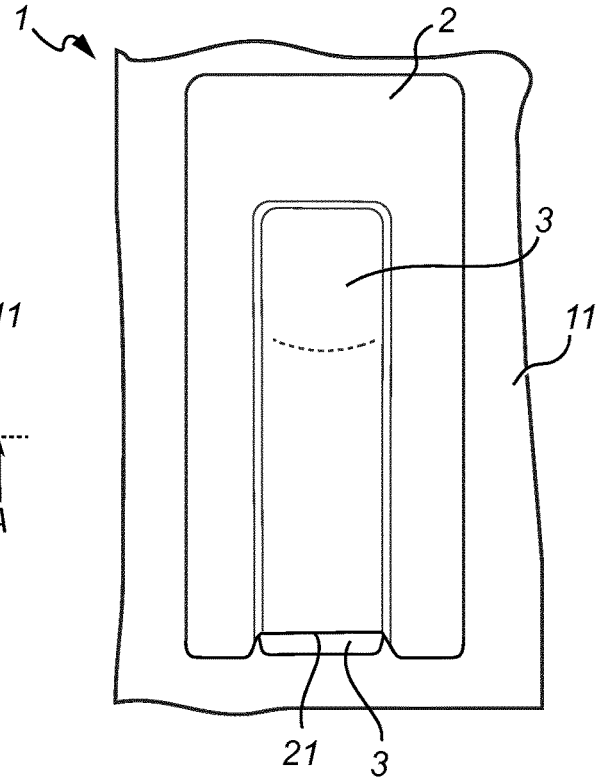
FIG. 2B illustrates a top view perspective of a one-way valve arranged on a food package, in accordance with another embodiment of the invention.

FIGS. 2A and 2B show top view perspectives of a one-way valve fixed to plastic film 11 of a food package in accordance with an embodiment of the invention. The second membrane 3 is preferably in the general form of an elongated structure, such as a rectangle, as in the embodiment shown. However, the skilled artisan readily realizes that other shapes such as ellipse, truncated cone, etc. are feasible. The second membrane 3 may have an aspect ratio of 1:1.5-5 (width:length). For example, the second membrane 3 may have a width in the range of 5-15 mm, such as e.g. 8-10 mm, and a length in the range of 7.5-75 mm, such as e.g. 20-30 mm. Width and length are considered to be the distance between two opposite edges along two appropriately arranged and perpendicular axes extending along the surface of the membrane.

Figure 3A:
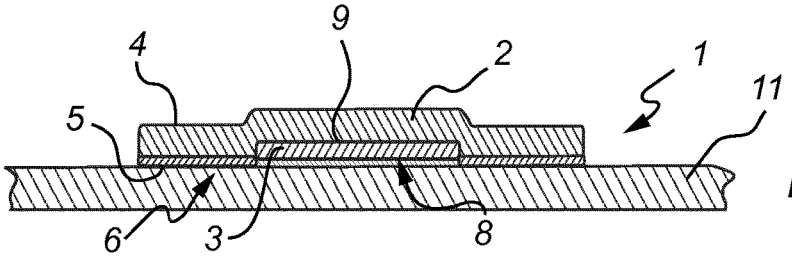
FIG. 3A illustrates a cross-sectional view taken along the line A-A in FIG. 2A, in accordance with an embodiment of the invention.
Figure 3B:
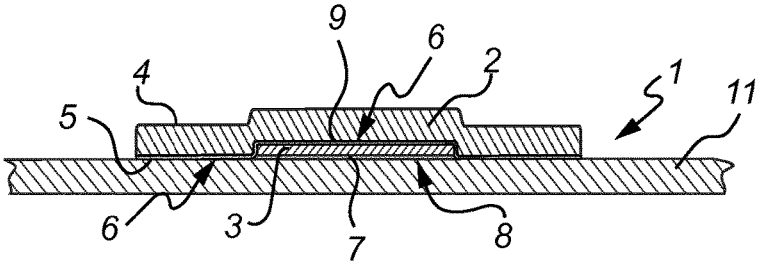
FIG. 3B illustrates another embodiment of the invention from the same perspective as in FIG. 3A.

FIGS. 3A and 3B show two different embodiments of a one-way valve 1 arranged on a plastic film 11 of a food container from a cross-sectional perspective taken along line A-A in FIG. 2A. In FIG. 3A the second membrane 3 is fixed to the first membrane 2, for example by means of ultrasonic welding, whereby there is no adhesive layer between the two membranes 2, 3. The bottom surface 7 of the second membrane 3 is coated with a first adhesive 8. The parts of the bottom surface 5 of the first membrane 2 which extends beyond the outer lateral edges of the second membrane 3 are however coated with a second adhesive 6, which has a higher adhesion than the first adhesive 8.

In FIG. 3B the bottom surface 7 of the second membrane 3 is coated with a first adhesive 8 and the entire bottom surface 5 of the first membrane 2 is coated with a second adhesive 6, the first adhesive 8 having lower adhesion than the second adhesive 6. By coating the whole bottom surface 5 of the first membrane 2 with a second adhesive 6 and using the same adhesive for fixing the two membranes 2, 3 to each other and also to fix the one-way valve to the food package, manufacturing complexity is reduced since otherwise more complex steps such as ultrasonic welding or using two different adhesives on different portions or sections of the same surface, can be omitted.

Figure 4A:
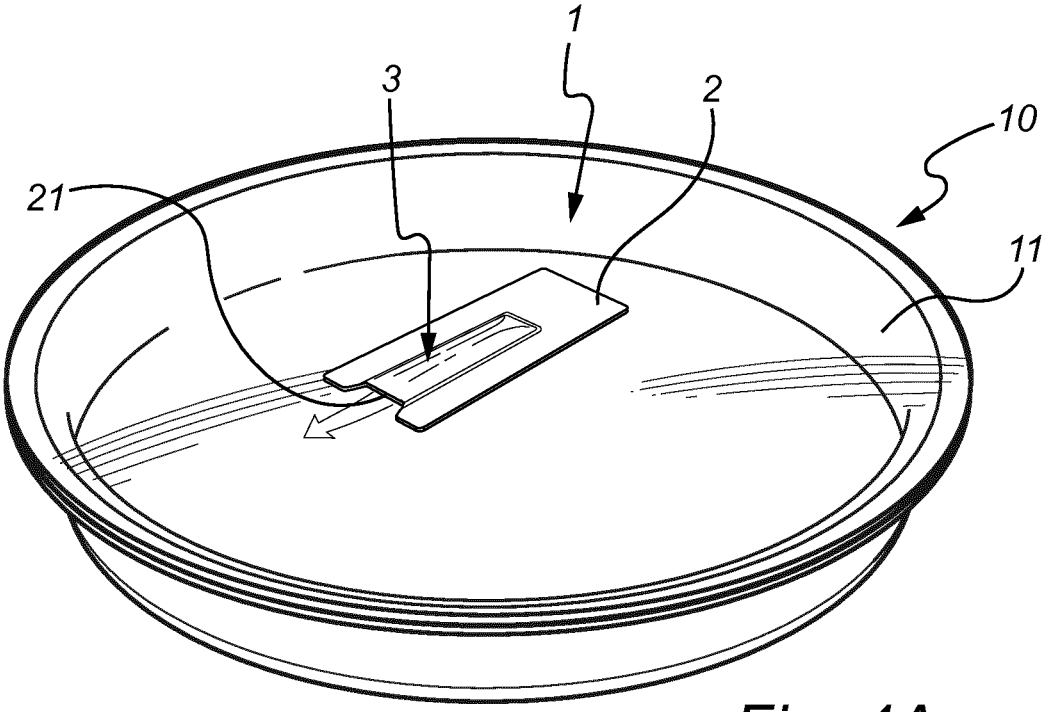
FIG. 4A illustrates a perspective view of the one-way valve from FIG. 1B, with an open canal, in accordance with an embodiment of the invention.

FIG. 4A illustrates a perspective view of a one-way valve 1 mounted over an aperture formed on a plastic film of a food package 10. In particular, the figure shows the one-way valve in use, i.e. in a situation when the gas pressure inside the food package 10 has exceeded a threshold value and a canal, through which gas/vapor may exit as indicated by the bolded arrow, has been formed between the second membrane 3 and the plastic film 11. The excess pressure inside the food package 10 is generated from heating the food package 10. The canal is formed as a result of the bond between the plastic film 11 and the bottom surface of the second membrane 3 temporarily breaking due to the surface pressure exerted by the gas onto the second membrane 3 covering the aperture 12 being too strong. The term temporarily is used since upon cease of heating of the package and its contents, pressure equalization occurs, and the valve 10 closes as a result second membrane 3 having an adhesive coating, and on account of resiliency of the first membrane 2, which resumes its original position in contact with the plastic film 11. Moreover, the adhesive applied onto the distal surface of the second membrane 3 is such that, once the gas pressure inside is reduced, to a level below the threshold value, the second membrane 3 adheres to the plastic film again.

Figure 4B:
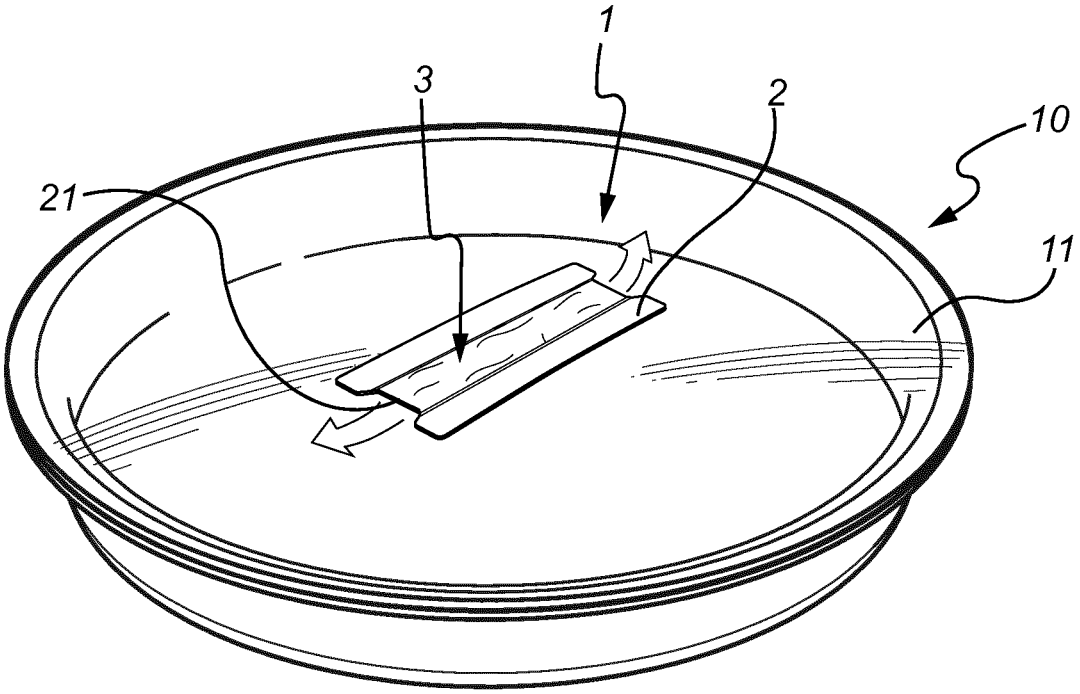
FIG. 4B illustrates a perspective view of a one-way valve, with an open canal, applied on a food package, in accordance with another embodiment of the invention.

FIG. 4B illustrates a perspective view of a one-way valve 1 mounted over an aperture formed on a plastic film 11 of a food package 10, according to another embodiment. The operation and functional principles are analogous to the embodiment illustrated in FIG. 4A, and will for the sake of brevity not be further elaborated upon. However, the one-way valve of FIG. 4B differs from that of FIG. 4A in that the canal, formed between the second membrane 3 and the plastic film 11, extends towards two peripheral edges of the first membrane 2. Thus, the gas/vapor from inside the food package 10 may exit through two paths as indicated by the bolded arrows.

Figure 5:
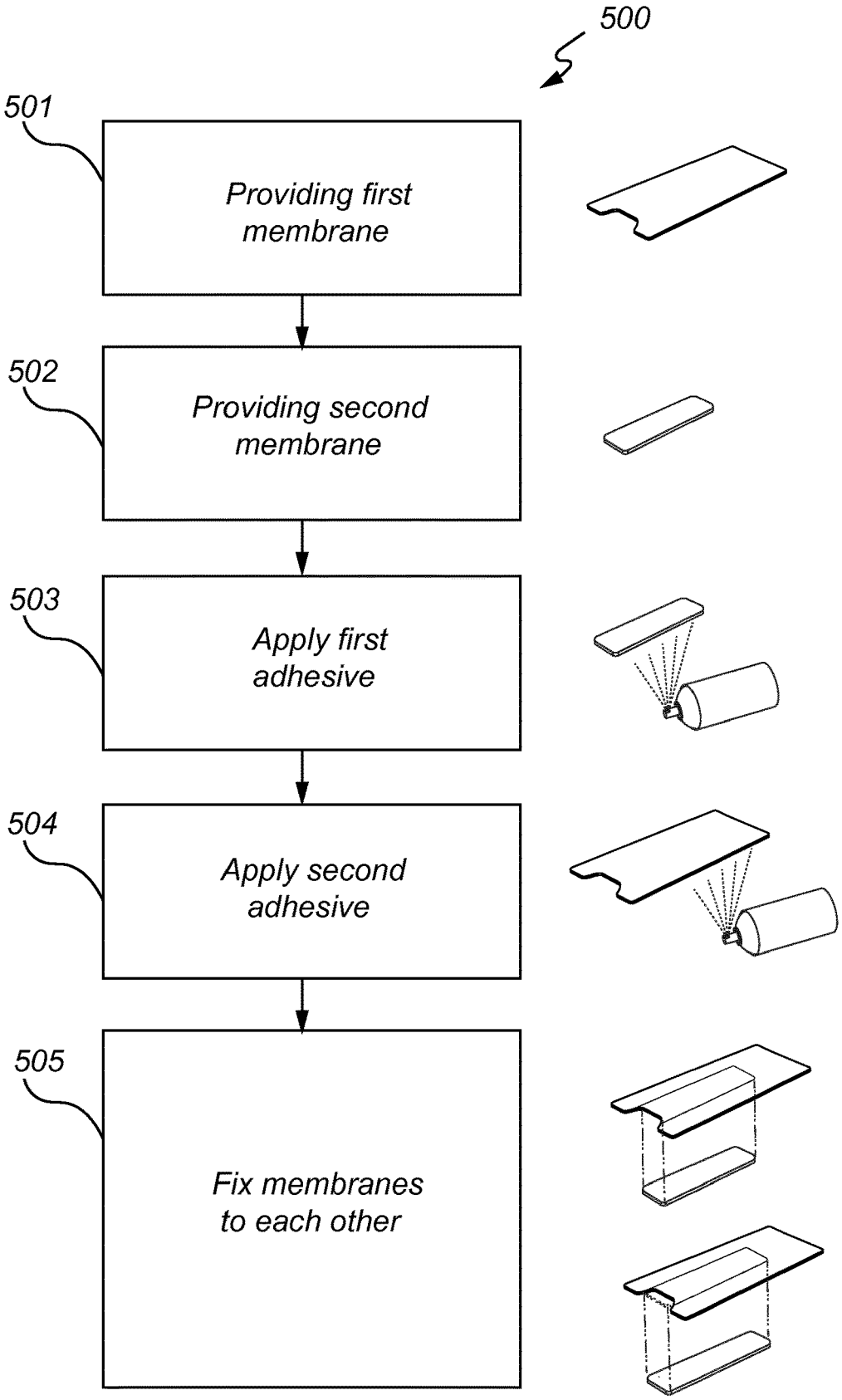
FIG. 5 illustrates a flow chart representation of a method for manufacturing a one-way valve in accordance with an embodiment of the invention.

FIG. 5 is a schematic flow chart representation of a manufacturing method 500 in accordance with an embodiment of the invention. In more detail, it is a method 500 for manufacturing a one-way valve for mounting over an aperture formed on a food package for cooking storing and/or heating ready-to-eat-food. The method 500 beings at step 501, wherein a first membrane with a first surface area is provided. The first membrane accordingly has a top surface and a bottom surface. Further, a second membrane having a proximal surface, a distal surface and a second surface area is provided at step 502. The second surface area is smaller than the first surface area.

Next, at step 503, the distal surface of the second membrane is coated with a first adhesive. At step 504, the bottom surface of the first membrane is also coated with a second adhesive, the first adhesive having lower adhesion than the second adhesive. As indicated in the figure, the adhesives may be sprayed onto the distal surface. However, other optional means for coating an adhesive are feasible, such as e.g. printing, dispensing, roll coating, transfer printing, screen printing, applying a solid film adhesive, brushing, etc. Also, as an alternative, the two surfaces (distal surface of the second membrane and bottom surface of the first membrane) may be coated with the same adhesive and the distal surface of the second membrane may additionally be coated with a release coating in order to lower the adhesion of the adhesive in a subsequent step.

At step 505, the two membranes are fixed to each other by fixing the proximal surface of the second membrane to the bottom surface of the first membrane. The two membranes are furthermore fixed to each other such that a peripheral edge of the second membrane aligns with or extends past at least one peripheral edge of the first membrane. The small illustrations next to block 505 indicate how the peripheral edges of the two membranes may be aligned (upper illustration) or how a peripheral edge of the second membrane may extend past a peripheral edge of the first membrane (lower illustration).

Even though the invention has been described with reference to specific exemplifying embodiments thereof, many different alterations, modifications and the like will become apparent for those skilled in the art. Thus, the above description of the various embodiments of the present invention and the accompanying drawings are to be regarded as non-limiting examples of the invention and the scope of protection is defined by the appended claims. For example, the opening in the plastic film need not have any specific shape, it may for example be semi-circular, star shaped, circular hole or a plurality of small holes.

Furthermore, any reference signs in the claims should not be construed as limiting the scope, and the word "comprising" does not exclude other elements or steps, and the indefinite articles "a" or "an" does not exclude a plurality.

The invention claimed is:

1. A one-way valve for mounting over an aperture formed on a food package for at least one of cooking, storing and heating of ready-to-eat food, said one-way valve comprising:

a first membrane with a top surface and a bottom surface, the first membrane having a first surface area;

a second membrane with a proximal surface and a distal surface, the second membrane having a second surface area smaller than the first surface area, wherein the distal surface is coated with an adhesive and the proximal surface of the second membrane is fixed to the bottom surface of the first membrane such that a peripheral edge of the second membrane aligns with or extends past a peripheral edge of the first membrane; and wherein the one-way valve is adapted to be fixed to said food package in order to cover said aperture with said second membrane such that a canal is formed between the food package and the second membrane when a gas pressure inside the food package exceeds a threshold value, said canal extending from said aperture to the peripheral edge of the first membrane along said second membrane.

2. The one-way valve according to claim 1, wherein said second membrane defines the canal through which gas inside the food package can exit when the gas pressure inside the food package exceeds the threshold value.

3. The one-way valve according to claim 1, wherein the distal surface of the second membrane is coated with a first adhesive, and wherein the bottom surface of the first membrane is coated with a second adhesive, said first adhesive having a lower adhesion than the second adhesive.

4. The one-way valve according to claim 3, wherein the lower adhesion is provided by a release coating.

5. The one-way valve according to claim 1, wherein the first membrane extends past at least two sides of the second membrane.

6. The one-way valve according to claim 1, wherein the first membrane is made of a thermoelastic material which has a production machine direction, and wherein the second membrane is arranged such that the canal extends in a direction that has a relationship to said production machine direction such that an angle therebetween is within a range of 60°-90°.

7. The one-way valve according to claim 6, wherein said thermoelastic material is in an elastic state at temperatures exceeding 50° C.

8. The one-way valve according to claim 7, wherein the first membrane is made of poly(vinyl chloride), and the second membrane is made of a different polymer.

9. The one-way valve according to claim 1, wherein the canal further extends from the aperture to an opposing peripheral edge of the first membrane.

10. The one-way valve according to claim 2, wherein the distal surface of the second membrane is coated with a first adhesive, and wherein the bottom surface of the first membrane is coated with a second adhesive, said first adhesive having a lower adhesion than the second adhesive.

11. The one-way valve according to claim 10, wherein the lower adhesion is provided by a release coating.

12. The one-way valve according to claim 1, wherein the first membrane is made of poly(vinyl) chloride, and the second membrane is made of a second polymer.

13. The one-way valve of claim 12, wherein the second polymer is selected from the list consisting of: polypropylene, polyethylene, polystyrene, and polyurethane.

14. The one-way valve of claim 4, wherein the first and second adhesives are the same adhesive.

15. A food package for at least one of cooking, storing and heating of ready-to-eat food, the food package comprising a food container and a plastic film for sealing the food package from ambient air, the plastic film including an aperture, wherein said food package further comprises a one-way valve covering said aperture, said one-way valve comprising:

a first membrane having a top surface and a bottom surface, the first membrane having a first surface area;

a second membrane having a proximal surface and a distal surface, the second membrane having a second surface area smaller than the first surface area, wherein the distal surface is coated with an adhesive and the proximal surface is fixed to the bottom surface of the first membrane such that a peripheral edge of the second membrane aligns with or extends past a peripheral edge of the first membrane; and wherein the one-way valve is arranged on said plastic film so that the second membrane covers the aperture whereby a canal is formed between the food package and the second membrane when a gas pressure inside the food package exceeds a threshold value, said canal extending from said aperture to the peripheral edge of the first membrane along said second membrane.

16. The food package according to claim 15, wherein the distal surface of the second membrane is coated with a first adhesive, and wherein the bottom surface of the first membrane is coated with a second adhesive, said first adhesive having a lower adhesion than the second adhesive.

17. The food package according to claim 15, wherein the aperture in the plastic film is a cut.

18. The one-way valve of claim 16, wherein the first and second adhesives are the same adhesive, and wherein the lower adhesion is provided by a release coating applied to the second membrane.

19. A method for manufacturing a one-way valve for mounting over an aperture formed on a food package for at least one of cooking, storing and heating of ready-to-eat food, said method comprising:

providing a first membrane having a top surface and a bottom surface, the first membrane having a first surface area;

providing a second membrane having a proximal surface and a distal surface, the second membrane having a second surface area smaller than the first surface area;

coating the distal surface of the second membrane with a first adhesive;

coating the bottom surface of the first membrane with a second adhesive, the first adhesive having lower adhesion than the second adhesive;

fixing the proximal surface second membrane to the bottom surface of the first membrane, such that a peripheral edge of the second membrane aligns with or extends past a peripheral edge of the first membrane.

20. The method according to claim 19, wherein the coating of the respective adhesives on the first and second membranes is accomplished by spraying.

* * * * *